US006904981B2

(12) United States Patent
van Riet

(10) Patent No.: US 6,904,981 B2
(45) Date of Patent: Jun. 14, 2005

(54) DYNAMIC ANNULAR PRESSURE CONTROL APPARATUS AND METHOD

(75) Inventor: Egbert Jan van Riet, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/368,128

(22) Filed: Feb. 18, 2003

(65) Prior Publication Data

US 2003/0196804 A1 Oct. 23, 2003

Related U.S. Application Data

(60) Provisional application No. 60/358,226, filed on Feb. 20, 2002.

(30) Foreign Application Priority Data

Aug. 1, 2003 (NL) ..... PCT/EP 03/08644

(51) Int. Cl.[7] ..... E21B 21/08

(52) U.S. Cl. ..... 175/66; 175/207; 166/265

(58) Field of Search ..... 166/265, 267, 166/105.1, 75.12, 192; 175/66, 206, 207

(56) References Cited

U.S. PATENT DOCUMENTS

| | | | | |
|---|---|---|---|---|
| 3,443,643 A | | 12/1966 | Jones | 175/25 |
| 3,677,353 A | | 7/1972 | Baker | 175/25 |
| 3,827,511 A | | 8/1974 | Jones | 175/25 |
| 4,630,675 A | | 12/1986 | Neipling et al. | 166/53 |
| 4,653,597 A | | 3/1987 | Johnson | 175/25 |
| 4,700,739 A | | 10/1987 | Flohr | 137/488 |
| 4,709,900 A | | 12/1987 | Dyhr | 251/5 |
| 5,010,966 A | * | 4/1991 | Stokley et al. | 175/66 |
| 5,305,836 A | | 4/1994 | Holbrook et al. | 175/39 |
| 5,437,308 A | | 8/1995 | Morin et al. | 138/45 |
| 5,443,128 A | | 8/1995 | Amaudric du Chaffaut | 175/25 |
| 5,474,142 A | | 12/1995 | Bowden | 175/27 |
| 5,857,522 A | * | 1/1999 | Bradfield et al. | 166/267 |
| 5,890,549 A | | 4/1999 | Sprehe | 175/71 |
| 5,975,219 A | | 11/1999 | Sprehe | 175/48 |
| 6,035,952 A | | 3/2000 | Bradfield et al. | 175/66 |
| 6,119,772 A | | 9/2000 | Pruet | 166/81.1 |
| 6,176,323 B1 | * | 1/2001 | Weirich et al. | 175/40 |
| 6,189,612 B1 | * | 2/2001 | Ward | 166/250.07 |
| 6,325,159 B1 | | 12/2001 | Peterman et al. | 175/7 |
| 6,352,129 B1 | | 3/2002 | Best | 175/25 |
| 6,374,925 B1 | * | 4/2002 | Elkins et al. | 175/25 |
| 6,394,195 B1 | | 5/2002 | Schubert et al. | 175/69 |
| 6,412,554 B1 | | 7/2002 | Allen et al. | 166/80.1 |
| 6,484,816 B1 | | 11/2002 | Koederitz | 175/25 |
| 6,527,062 B2 | | 3/2003 | Elkins et al. | 175/25 |
| 6,571,873 B2 | | 6/2003 | Maus | 166/250.07 |
| 6,575,244 B2 | | 6/2003 | Chang et al. | 166/250.15 |
| 2002/0112888 A1 | | 8/2002 | Leuchtenberg | 175/48 |
| 2003/0079912 A1 | | 5/2003 | Leuchtenberg | 175/38 |

FOREIGN PATENT DOCUMENTS

| | | | |
|---|---|---|---|
| EP | 0 436242 A1 | 7/1991 | E21B/21/08 |
| WO | 00/04269 A32 | 1/2000 | |
| WO | 00/79092 A2 | 12/2000 | E21B/21/08 |
| WO | 02/50398 | 6/2002 | E21B/21/08 |

* cited by examiner

*Primary Examiner*—Frank Tsay

(57) ABSTRACT

A system and method for controlling formation pressures during drilling of a subterranean formation utilizing a selectively fluid backpressure system in which fluid is pumped down the drilling fluid return system in response to detected borehole pressures. A pressure monitoring system is further provided to monitor detected borehole pressures, model expected borehole pressures for further drilling and control the fluid backpressure system.

12 Claims, 9 Drawing Sheets

DYNAMIC ANNULAR PRESSURE CONTROL APPARATUS AND METHOD

This application claims the benefit of provisional application No. 60/358,226, filed Feb. 20, 2002.

FIELD OF THE INVENTION

The present method and apparatus are related to a method for dynamic well borehole annular pressure control, more specifically, a selectively closed-loop, pressurized method for controlling borehole pressure during drilling and other well completion operations.

BACKGROUND OF THE ART

The exploration and production of hydrocarbons from subsurface formations ultimately requires a method to reach and extract the hydrocarbons from the formation. This is typically done with a drilling rig. In its simplest form, this constitutes a land-based drilling rig that is used to support a drill bit mounted on the end of drill string, comprised of a series of drill tubulars. A fluid comprised of a base fluid, typically water or oil, and various additives are pumped down the drill string, and exits through the rotating drill bit. The fluid then circulates back up the annulus formed between the borehole wall and the drill bit, taking with it the cuttings from the drill bit and clearing the borehole. The fluid is also selected such that the hydrostatic pressure applied by the fluid is greater than surrounding formation pressure, thereby preventing formation fluids from entering into the borehole. It also causes the fluid to enter into the formation pores, or "invade" the formation. Further, some of the additives from the pressurized fluid adhere to the formation walls forming a "mud cake" on the formation walls. This mud cake helps to preserve and protect the formation prior to the setting of casing in the drilling process, as will be discussed further below. The selection of fluid pressure in excess of formation pressure is commonly referred to as over balanced drilling. The fluid then returns to the surface, where it is bled off into a mud system, generally comprised of a shaker table, to remove solids, a mud pit and a manual or automatic means for addition of various chemicals or additives to the returned fluid. The clean, returned fluid flow is measured to determine fluid losses to the formation as a result of fluid invasion. The returned solids and fluid (prior to treatment) may be studied to determine various formation characteristics used in drilling operations. Once the fluid has been treated in the mud pit, it is then pumped out of the mud pit and re-injected into the top of the drill string again.

This overbalanced technique is the most commonly used fluid pressure control method. It relies primarily on the fluid density and hydrostatic force generated by the column of fluid in the annulus to generate pressure. By exceeding the formation pore pressure, the fluid is used to prevent sudden releases of formation fluid to the borehole, such as gas kicks. Where such gas kicks occur, the density of the fluid may be increased to prevent further formation fluid release to the borehole. However, the addition of weighting additives to increase fluid density (a) may not be rapid enough to deal with the formation fluid release and (b) may exceed the formation fracture pressure, resulting in the creation of fissures or fractures in the formation, with resultant fluid loss to the formation, possibly adversely affecting near borehole permeability. In such events, the operator may elect to close the blow out preventors (BOP) below the drilling rig floor to control the movement of the gas up the annulus. The gas is bled off and the fluid density is increased prior to resuming drilling operations.

The use of overbalanced drilling also affects the selection of casing during drilling operations. The drilling process starts with a conductor pipe being driven into the ground, a BOP stack attached to the drilling conductor, with the drill rig positioned above the BOP stack. A drill string with a drill bit may be selectively rotated by rotating the entire string using the rig kelly or a top drive, or may be rotated independent of the drill string utilizing drilling fluid powered mechanical motors installed in the drill string above the drill bit. As noted above, an operator may drill open hole for a period until such time as the accumulated fluid pressure at a calculated depth nears that of the formation fracture pressure. At that time, it is common practice to insert and hang a casing string in the borehole from the surface down to the calculated depth. A cementing shoe is placed on the drill string and specialized cement is injected into the drill string, to travel up the annulus and displace any fluid then in the annulus. The cement between the formation wall and the outside of the casing effectively supports and isolates the formation from the well bore annulus and further open hole drilling is carried out below the casing string, with the fluid again providing pressure control and formation protection.

FIG. 1 is an exemplary diagram of the use of fluids during the drilling process in an intermediate borehole section. The top horizontal bar represents the hydrostatic pressure exerted by the drilling fluid and the vertical bar represents the total vertical depth of the borehole. The formation pore pressure graph is represented by line 10. As noted above, in an over balanced situation, the fluid pressure exceeds the formation pore pressure for reasons of pressure control and hole stability. Line 12 represents the formation fracture pressure. Pressures in excess of the formation fracture pressure will result in the fluid pressurizing the formation walls to the extent that small cracks or fractures will open in the borehole wall and the fluid pressure overcomes the formation pressure with significant fluid invasion. Fluid invasion can result in reduced permeability, adversely affecting formation production. The annular pressure generated by the fluid and its additives is represented by line 14 and is a linear function of the total vertical depth. The pure hydrostatic pressure that would be generated by the fluid, less additives, i.e., water, is represented by line 16.

In an open loop fluid system described above, the annular pressure seen in the borehole is a linear function of the borehole fluid. This is true only where the fluid is at a static density. While the fluid density may be modified during drilling operations, the resulting pressure annular pressure is generally linear. In FIG. 1, the hydrostatic pressure 16 and the pore pressure 10 generally track each other in the intermediate section to a depth of approximately 7000 feet. Thereafter, the pore pressure 10 increases in the interval from a depth of 7000 feet to approximately 9300 feet. This may occur where the borehole penetrates a formation interval having significantly different characteristics than the prior formation. The annular pressure 14 maintained by the fluid 14 is safely above the pore pressure prior to 7000 feet. In the 7000–9300 foot interval, the differential between the pore pressure 10 and annular pressure 14 is significantly reduced, decreasing the margin of safety during operations. A gas kick in this interval may result in the pore pressure exceeding the annular pressure with a release of fluid and gas into the borehole, possibly requiring activation of the surface BOP stack. As noted above, while additional weighting material may be added to the fluid, it will be generally ineffective in dealing with a gas kick due to the time required to increase the fluid density as seen in the borehole.

Fluid circulation itself also creates problems in an open system. It will be appreciated that it is necessary to shut off the mud pumps in order to make up successive drill pipe joints. When the pumps are shut off, the annular pressure will undergo a negative spike that dissipates as the annular pressure stabilizes. Similarly, when the pumps are turned back on, the annular pressure will undergo a positive spike. This occurs each time a pipe joint is added to or removed from the string. It will be appreciated that these spikes can cause fatigue on the borehole cake and could result in formation fluids entering the borehole, again leading to a well control event.

In contrast to open fluid circulation systems, there have been developed a number of closed fluid handling systems. Examples of these include U.S. Pat. Nos. 5,857,522 and 6,035,952, both to Bradfield et al. and assigned to Baker Hughes Incorporated. In these patents, a closed system is used for the purposes of underbalanced drilling, i.e., the annular pressure is less than that of the formation pore pressure. Underbalanced drilling is generally used where the formation is a chalk or other fractured limestone and the desire is to prevent the mud cake from plugging fractures in the formation. Moreover, it will be appreciated that where underbalanced systems are used, a significant well event will require that the BOPs be closed to handle the kick or other sudden pressure increase.

Other systems have been designed to maintain fluid circulation during the addition or removal of additional drill string tubulars (make/break). In U.S. Pat. No. 6,352,129, assigned to Shell Oil Company, assignee of the present invention, a continuous circulation system is shown whereby the make up/break operations and the separate pipe sections are isolated from each other in a fluid chamber 20 and a secondary conduit 28 is used to supply pumped fluid to that portion of the drill string 12 still in fluid communications with the formation. In a second implementation, the publication discloses an apparatus and method for injecting a fluid or gas into the fluid stream after the pumps have been turned off to maintain and control annular pressure.

SUMMARY OF THE PRESENT INVENTION

The present invention is directed to a closed loop, overbalanced drilling system having a variable overbalance pressure capability. The present invention further utilizes information related to the wellbore, drill rig and drilling fluid as inputs to a model to predict downhole pressure. The predicted downhole pressure is then compared to a desired downhole pressure and the differential is utilized to control a backpressure system. The present invention further utilizes actual downhole pressure to calibrate the model and modify input parameters to more closely correlate predicted downhole pressures to measured downhole pressures.

In one aspect, the present invention is capable of modifying annular pressure during circulation by the addition of backpressure, thereby increasing the annular pressure without the addition of weighting additives to the fluid. It will be appreciated that the use of backpressure to increase annular pressure is more responsive to sudden changes in formation pore pressure.

In yet another aspect, the present invention is capable of maintaining annular pressure during pump shut down when drill pipe is being added to or removed from the string. By maintaining pressure in the annulus, the mud cake build up on the formation wall is maintained and does not see sudden spikes or drops in annular pressure.

In yet another aspect, the present invention utilizes an accurate mass-balance flow meter that permits accurate determination of fluid gains or losses in the system, permitting the operator to better manage the fluids involve in the operation.

In yet another aspect, the present invention includes automated sensors to determine annular pressure, flow, and with depth information, can be used to predict pore pressure, allowing the present invention to increase annular pressure in advance of drilling through the section in question.

BRIEF DESCRIPTION OF THE DRAWINGS

A better understanding of the present invention may be had by referencing the following drawings in conjunction with the Detailed Description of the Preferred Embodiment, in which.

DETAILED DESCRIPTION OF THE PREFERRED EMBODIMENT

The present invention is intended to achieve Dynamic Annulus Pressure Control (DAPC) of a well bore during drilling and intervention operations.

Structure of the Preferred Embodiment

Figure 2:
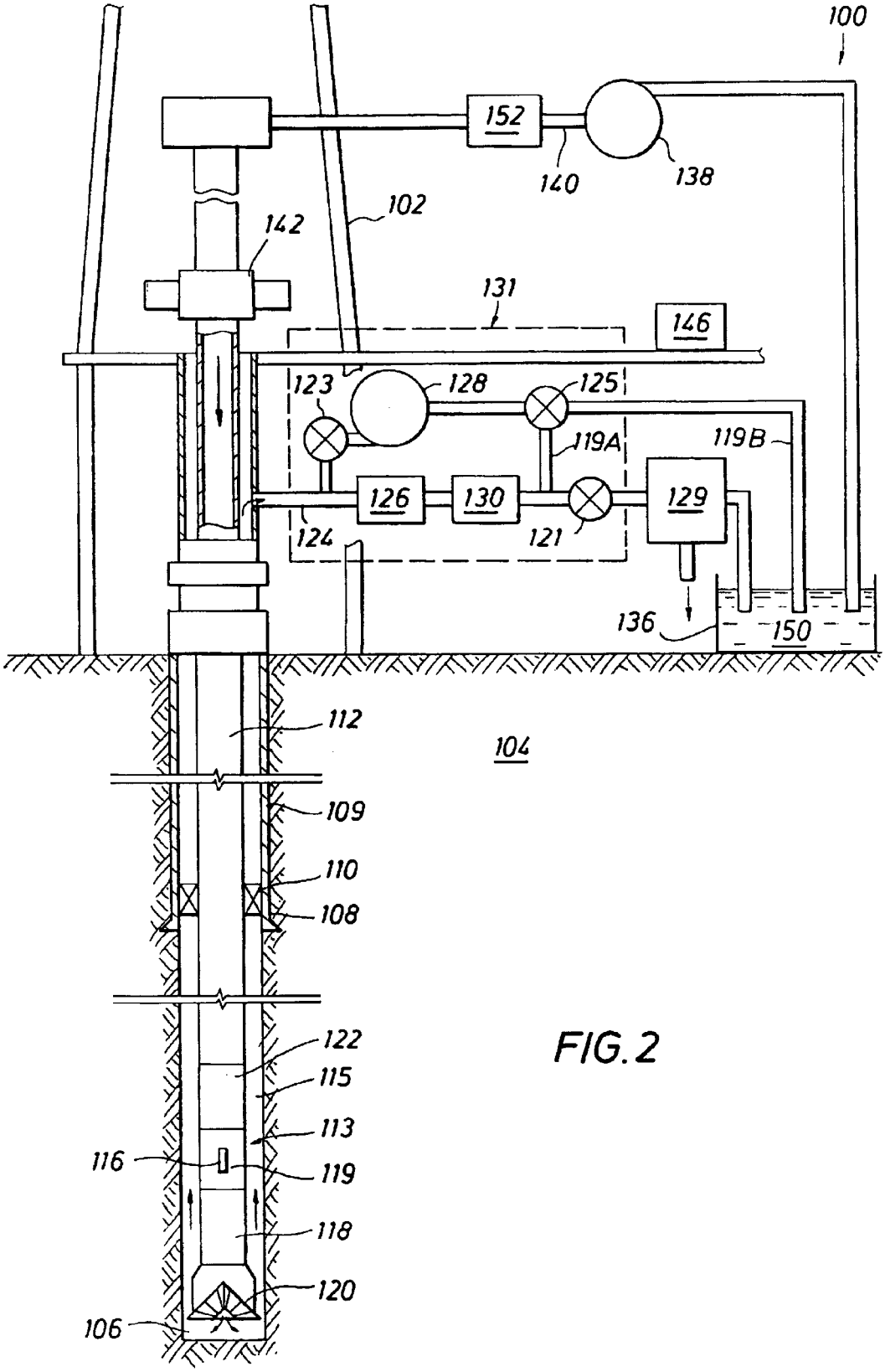
FIGS. 2A and 2B are plan views of two different embodiments of the apparatus of of the invention.
Figure 2A:
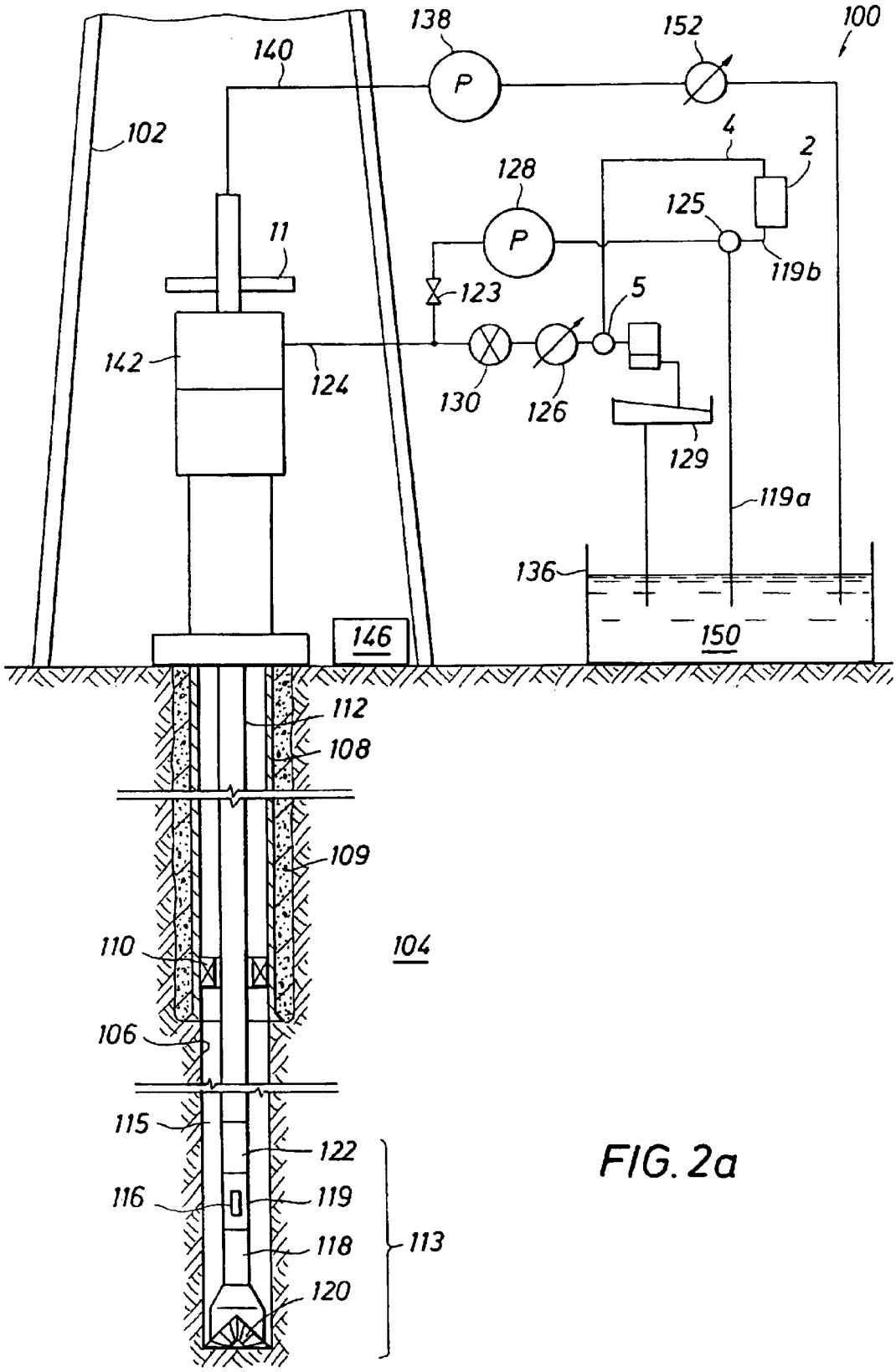

FIG. 2A is a plan view depicting a surface drilling system employing the current invention. It will be appreciated that an offshore drilling system may likewise employ the current invention. The drilling system 100 is shown as being comprised of a drilling rig 102 that is used to support drilling operations. Many of the components used on a rig 102, such as the kelly, power tongs, slips, draw works and other equipment are not shown for ease of depiction. The rig 102 is used to support drilling and exploration operations in formation 104. As depicted in FIG. 2 the borehole 106 has already been partially drilled, casing 108 set and cemented 109 into place. In the preferred embodiment, a casing shutoff mechanism, or downhole deployment valve, 110 is installed in the casing 108 to optionally shutoff the annulus and effectively act as a valve to shut off the open hole section when the bit is located above the valve.

The drill string 112 supports a bottom hole assembly (BHA) 113 that includes a drill bit 120, a mud motor 118, a MWD/LWD sensor suite 119, including a pressure transducer 116 to determine the annular pressure, a check valve, to prevent backflow of fluid from the annulus. It also includes a telemetry package 122 that is used to transmit pressure, MWD/LWD as well as drilling information to be received at the surface. While FIG. 2A illustrates a BHA utilizing a mud telemetry system, it will be appreciated that other telemetry systems, such as radio frequency (RF), electromagnetic (EM) or drilling string transmission systems may be employed within the present invention.

As noted above, the drilling process requires the use of a drilling fluid 150, which is stored in reservoir 136. The reservoir 136 is in fluid communications with one or more mud pumps 138 which pump the drilling fluid 150 through conduit 140. The conduit 140 is connected to the last joint of the drill string 112 that passes through a rotating or spherical BOP 142. A rotating BOP 142, when activated, forces spherical shaped elastomeric elements to rotate upwardly, closing around the drill string 112, isolating the pressure, but still permitting drill string rotation. Commercially available spherical BOPs, such as those manufactured by Varco International, are capable of isolating annular pressures up to 10,000 psi (68947.6 kPa). The fluid 150 is pumped down through the drill string 112 and the BHA 113 and exits the drill bit 120, where it circulates the cuttings away from the bit 120 and returns them up the open hole annulus 115 and then the annulus formed between the casing 108 and the drill string 112. The fluid 150 returns to the surface and goes through diverter 117, through conduit 124 and various surge tanks and telemetry systems (not shown).

Thereafter the fluid 150 proceeds to what is generally referred to as the backpressure system 131. The fluid 150 enters the backpressure system 131 and flows through a flow meter 126. The flow meter 126 may be a mass-balance type or other high-resolution flow meter. Utilizing the flow meter 126, an operator will be able to determine how much fluid 150 has been pumped into the well through drill string 112 and the amount of fluid 150 returning from the well. Based on differences in the amount of fluid 150 pumped versus fluid 150 returned, the operator is be able to determine whether fluid 150 is being lost to the formation 104, which may indicate that formation fracturing has occurred, i.e., a significant negative fluid differential. Likewise, a significant positive differential would be indicative of formation fluid entering into the well bore.

The fluid 150 proceeds to a wear resistant choke 130. It will be appreciated that there exist chokes designed to operate in an environment where the drilling fluid 150 contains substantial drill cuttings and other solids. Choke 130 is one such type and is further capable of operating at variable pressures and through multiple duty cycles. The fluid 150 exits the choke 130 and flows through valve 121. The fluid 150 is then processed by an optional degasser 1 and by a series of filters and shaker table 129, designed to remove contaminates, including cuttings, from the fluid 150. The fluid 150 is then returned to reservoir 136. A flow loop 119A, is provided in advance of valve 125 for feeding fluid 150 directly a backpressure pump 128. Alternatively, the backpressure pump 128 may be provided with fluid from the reservoir through conduit 119B, which is fluid communications with the reservoir 1 (trip tank). The trip tank is normally used on a rig to monitor fluid gains and losses during tripping operations. In the this invention, this functionality is maintained. A three-way valve 125 may be used to select loop 119A, conduit 119B or isolate the backpressure system. While backpressure pump 128 is capable of utilizing returned fluid to create a backpressure by selection of flow loop 119A, it will be appreciated that the returned fluid could have contaminates that have not been removed by filter/shaker table 129. As such, the wear on backpressure pump 128 may be increased. As such, the preferred fluid supply to create a backpressure would be to use conduit 119A to provide reconditioned fluid to backpressure pump 128.

In operation, valve 125 would select either conduit 119A or conduit 119B, and the backpressure pump 128 engaged to ensure sufficient flow passes the choke system to be able to maintain backpressure, even when there is no flow coming from the annulus 115. In the preferred embodiment, the backpressure pump 128 is capable of providing up to approximately 2200 psi (15168.5 kPa) of backpressure; though higher pressure capability pumps may be selected.

The ability to provide backpressure is a significant improvement over normal fluid control systems. The pressure in the annulus provided by the fluid is a function of its density and the true vertical depth and is generally a by approximation linear function. As noted above, additives added to the fluid in reservoir 136 must be pumped downhole to eventually change the pressure gradient applied by the fluid 150.

The preferred embodiment of the present invention further includes a flow meter 152 in conduit 100 to measure the amount of fluid being pumped downhole. It will be appreciated that by monitoring flow meters 126, 152 and the volume pumped by the backpressure pump 128, the system is readily able to determine the amount of fluid 150 being lost to the formation, or conversely, the amount of formation fluid leaking to the borehole 106. Further included in the present invention is a system for monitoring well pressure conditions and predicting borehole 106 and annulus 115 pressure characteristics.

Figure 2B:
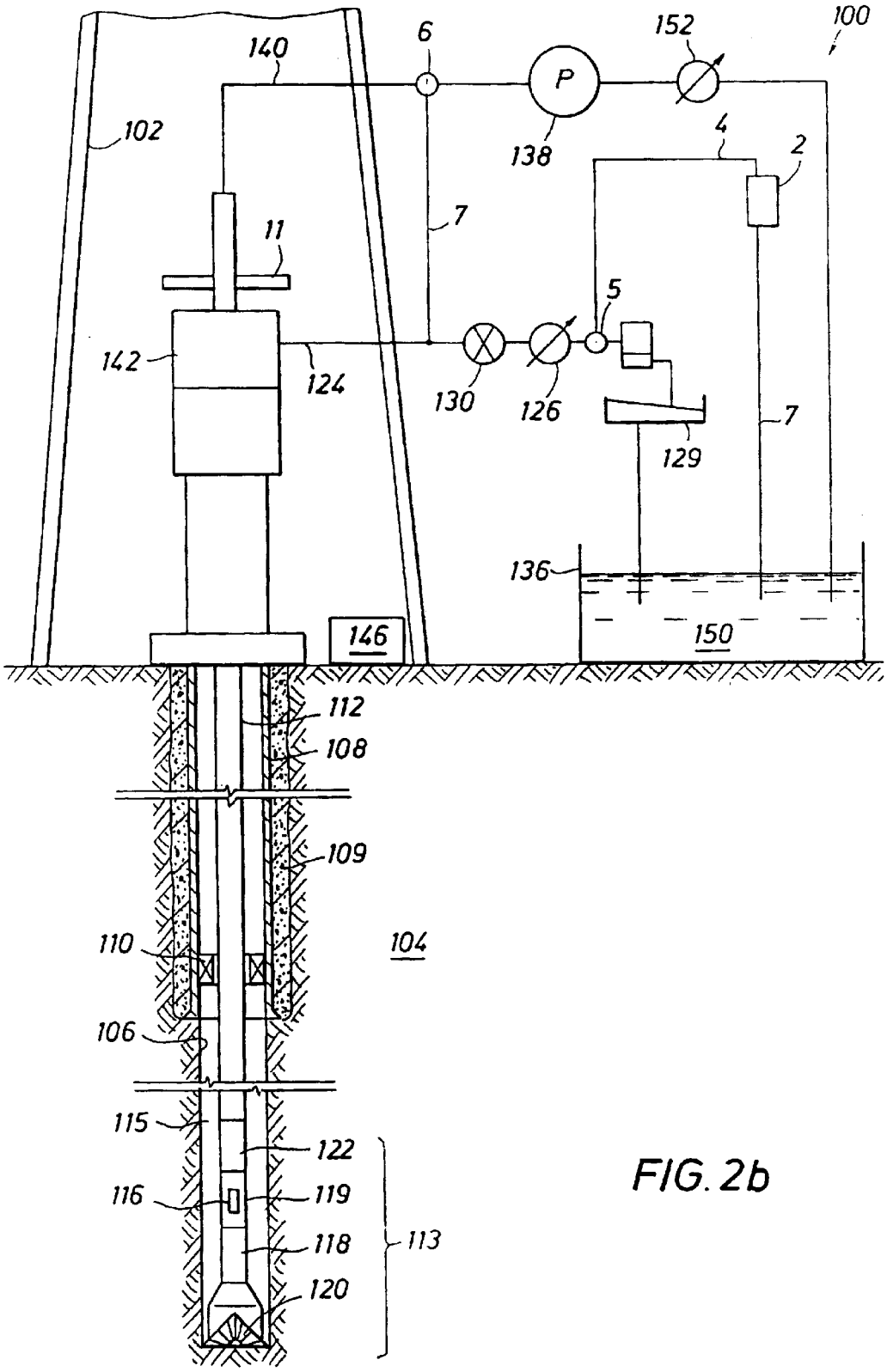

FIG. 2B depicts an alternative embodiment of the system. In this embodiment the backpressure pump is not required to maintain sufficient flow through the choke system when the flow through the well needs to be shut off for any reason. In this embodiment, an additional three way valve 6 is placed downstream of the rig pump 138 in conduit 140. This valve allows fluid from the rig pumps to be completely diverted from conduit 140 to conduit 7, not allowing flow from the rig pump 138 to enter the drill string 112. By maintaining pump action of pump 138, sufficient flow through the manifold to control backpressure is ensured.

DAPC Monitoring System

Figure 3:
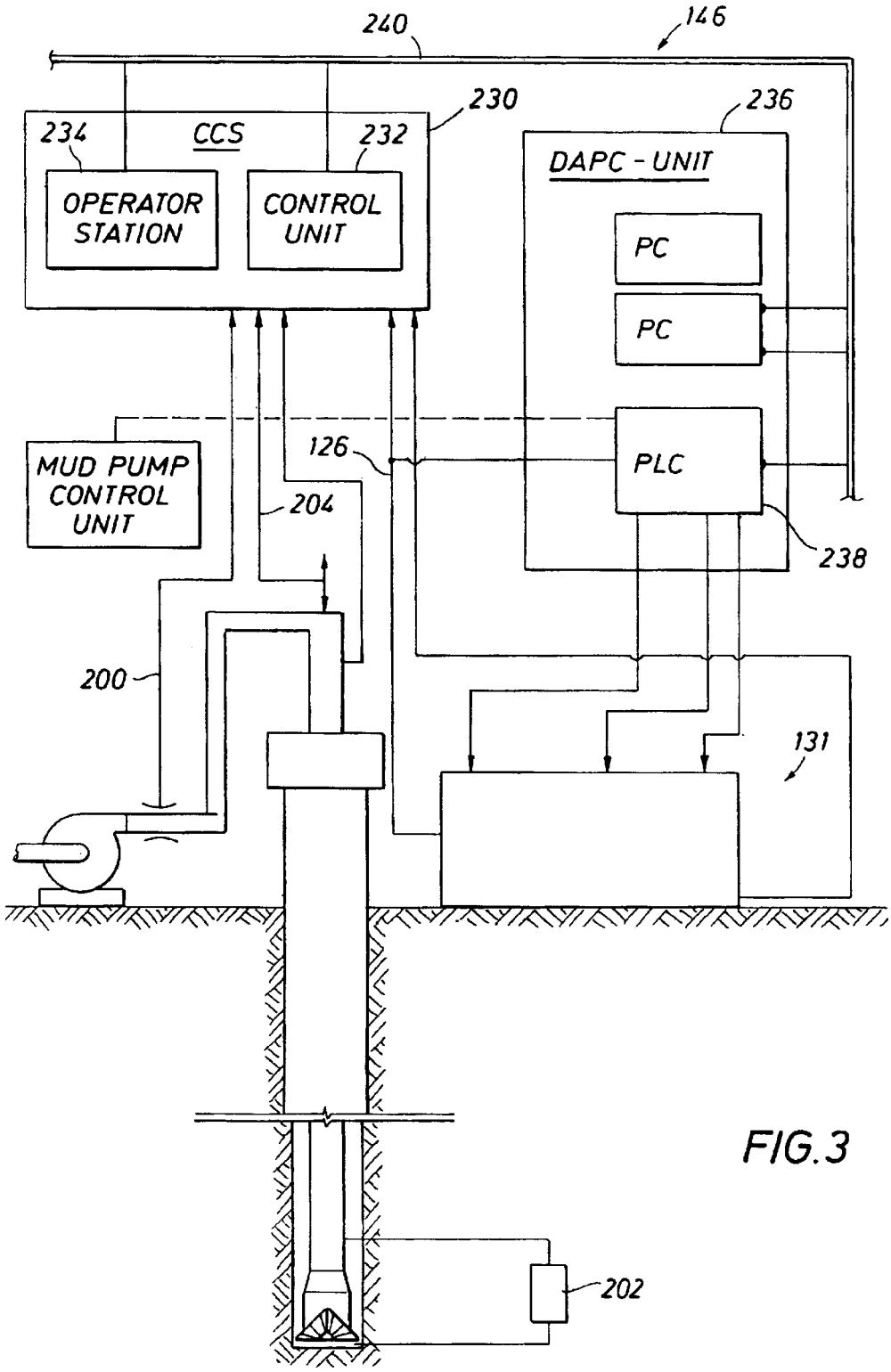
FIG. 3 is a block diagram of the pressure monitoring and control system utilized in the preferred embodiment.

FIG. 3 is a block diagram of the pressure monitoring system 146 of the preferred embodiment of the present invention. System inputs to the monitoring system 146 include the downhole pressure 202 that has been measured by sensor package 119, transmitted by MWD pulser package 122 and received by transducer equipment (not shown) on the surface. Other system inputs include pump pressure 200, input flow 204 from flow meter 152, penetration rate and string rotation rate, as well as weight on bit (WOB) and torque on bit (TOB) that may be transmitted from the BHA 113 up the annulus as a pressure pulse. Return flow is measured using flow meter 126. Signals representative of the data inputs are transmitted to a control unit 230, which is it self comprised of a drill rig control unit 232, a drilling operator's station 234, a DAPC processor 236 and a back pressure programmable logic controller (PLC) 238, all of which are connected by a common data network 240. The DAPC processor 236 serves three functions, monitoring the state of the borehole pressure during drilling operations, predicting borehole response to continued drilling, and issuing commands to the backpressure PLC to control the variable choke 130 and backpressure pump 128. The specific logic associated with the DAPC processor 236 will be discussed further below.

Calculation of Backpressure

Figure 4:
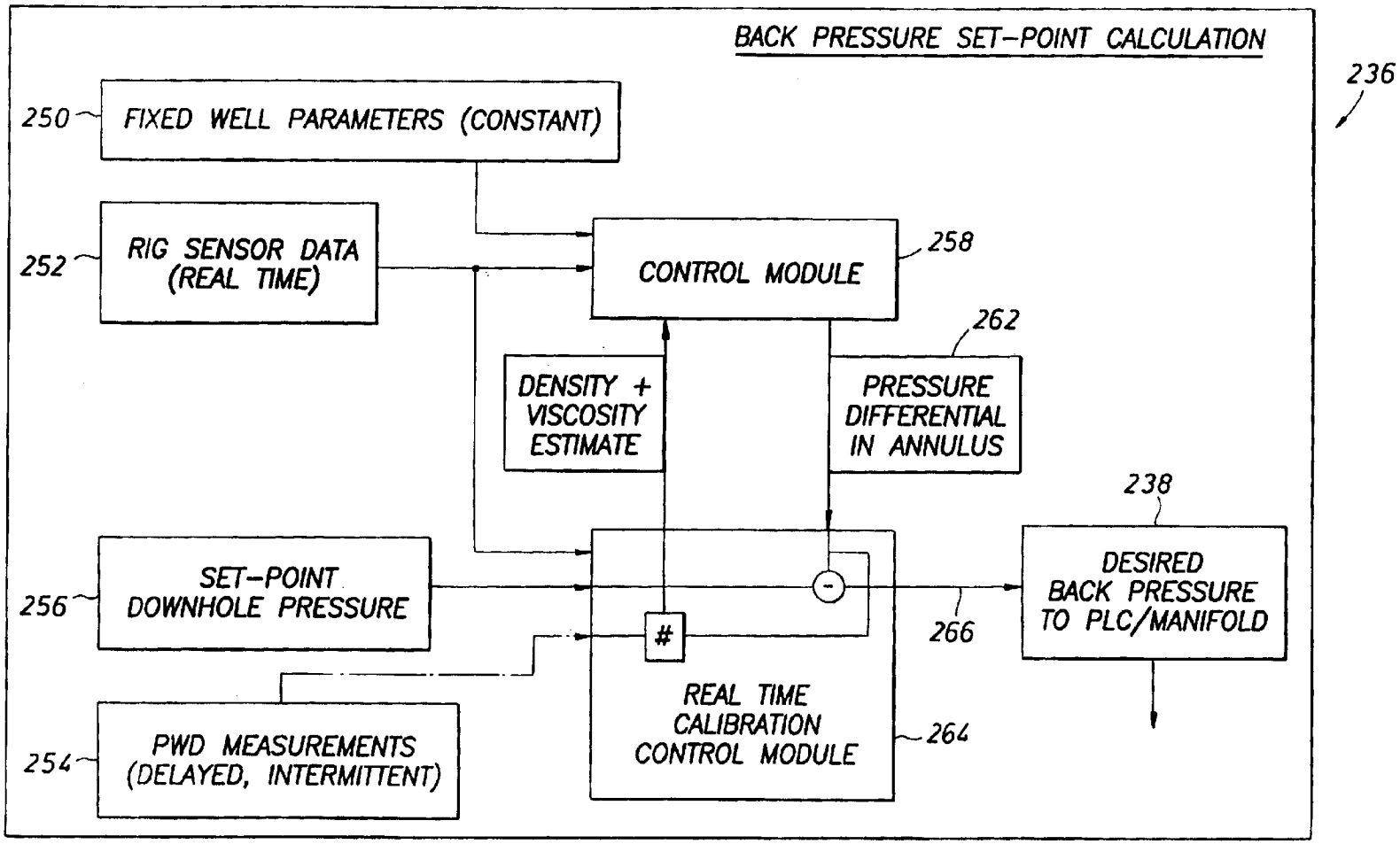
FIG. 4 is a functional diagram of the operation of the pressure monitoring and control system.

A schematic model of the functionality of the DAPC pressure monitoring system 146 is set forth in FIG. 4. The DAPC processor 236 includes programming to carry out Control functions and Real Time Model Calibration functions. The DAPC processor receives data from various sources and continuously calculates in real time the correct backpressure set-point based on the input parameters. The set-point is then transferred to the programmable logic controller 238, which generates the control signals for backpressure pump 128. The input parameters fall into three main groups. The first are relatively fixed parameters 250, including parameters such as well and casing string geometry, drill bit nozzle diameters, and well trajectory. While it is recognized that the actual well trajectory may vary from the planned trajectory, the variance may be taken into account with a correction to the planned trajectory. Also within this group of parameters are temperature profile of the fluid in the annulus and the fluid composition. As with the trajectory parameters, these are generally known and do not change over the course of the drilling operations. In particular, with the DAPC system, one objective is keeping the fluid 150 density and composition relatively constant, using backpressure to provide the additional pressure to control the annulus pressure.

The second group of parameters 252 are variable in nature and are sensed and logged in real time. The common data network 240 provides this information to the DAPC processor 236. This information includes flow rate data provided by both downhole and return flow meters 152 and 126, respectively, the drill string rate of penetration (ROP) or velocity, the drill string rotational speed, the bit depth, and the well depth, the latter two being derived from rig sensor data. The last parameter is the downhole pressure data 254 that is provided by the downhole MWD/LWD sensor suite 119 and transmitted back up the annulus by the mud pulse telemetry package 122. One other input parameters is the set-point downhole pressure 256, the desired annulus pressure.

The functionally the control module 258 attempts to calculate the pressure in the annulus over its fill well bore length utilizing various models designed for various formation and fluid parameters. The pressure in the well bore is a function not only of the pressure or weight of the fluid column in the well, but includes the pressures caused by drilling operations, including fluid displacement by the drill string, frictional losses returning up the annulus, and other factors. In order to calculate the pressure within the well, the control module 258 considers the well as a finite number of segments, each assigned to a segment of well bore length. In each of the segments the dynamic pressure and the fluid weight is calculated and used to determine the pressure differential 262 for the segment. The segments are summed and the pressure differential for the entire well profile is determined.

It is known that the flow rate of the fluid 150 being pumped downhole is proportional to the flow velocity of fluid 150 and may be used to determine dynamic pressure loss as the fluid is being pumped downhole. The fluid 150 density is calculated in each segment, taking into account the fluid compressibility, estimated cutting loading and the thermal expansion of the fluid for the specified segment, which is itself related to the temperature profile for that segment of the well. The fluid viscosity at the temperature profile for the segment is also instrumental in determining dynamic pressure losses for the segment. The composition of the fluid is also considered in determining compressibility and the thermal expansion coefficient. The drill string ROP is related to the surge and swab pressures encountered during drilling operations as the drill string is moved into or out of the borehole. The drill string rotation is also used to determine dynamic pressures, as it creates a frictional force between the fluid in the annulus and the drill string. The bit depth, well depth, and well/string geometry are all used to help create the borehole segments to be modeled. In order to calculate the weight of the fluid, the preferred embodiment considers not only the hydrostatic pressure exerted by fluid 150, but also the fluid compression, fluid thermal expansion and the cuttings loading of the fluid seen during operations. It will be appreciated that the cuttings loading can be determined as the fluid is returned to the surface and reconditioned for further use. All of these factors go into calculation of the "static pressure".

Dynamic pressure considers many of the same factors in determining static pressure. However, it further considers a number of other factors. Among them is the concept of laminar versus turbulent flow. The flow characteristics are a function of the estimated roughness, hole size and the flow velocity of the fluid. The calculation also considers the specific geometry for the segment in question. This would include borehole eccentricity and specific drill pipe geometry (box/pin upsets) that affect the flow velocity seen in the borehole annulus. The dynamic pressure calculation further includes cuttings accumulation downhole, as well as fluid rheology and the drill string movement's (penetration and rotation) effect on dynamic pressure of the fluid.

The pressure differential 262 for the entire annulus is calculated and compared to the set-point pressure 251 in the control module 264. The desired backpressure 266 is then determined and passed on to programmable logic controller 238, which generates control signals for the backpressure pump 128.

Calibration and Correction of the Backpressure

The above discussion of how backpressure is generally calculated utilized several downhole parameters, including downhole pressure and estimates of fluid viscosity and fluid density. These parameters are determined downhole and transmitted up the mud column using pressure pulses. Because the data bandwidth for mud pulse telemetry is very low and the bandwidth is used by other MWD/LWD functions, as well as drill string control functions, downhole pressure, fluid density and viscosity can not be input to the DAPC model on a real time basis. Accordingly, it will be appreciated that there is likely to be a difference between the measured downhole pressure, when transmitted up to the surface, and the predicted downhole pressure for that depth. When such occurs the DAPC system computes adjustments to the parameters and implements them in the model to make a new best estimate of downhole pressure. The corrections to the model may be made by varying any of the variable parameters. In the preferred embodiment, the fluid density and the fluid viscosity are modified in order to correct the predicted downhole pressure. Further, in the present embodiment the actual downhole pressure measurement is used only to calibrate the calculated downhole pressure. It is not utilized to predict downhole annular pressure response. If downhole telemetry bandwidth increases, it may then be practical to include real time downhole pressure and temperature information to correct the model.

Because there is a delay between the measurement of downhole pressure and other real time inputs, the DAPC control system 236 further operates to index the inputs such that real time inputs properly correlate with delayed downhole transmitted inputs. The rig sensor inputs, calculated pressure differential and backpressure pressures, as well as the downhole measurements, may be "time-stamped" or "depth-stamped" such that the inputs and results may be properly correlated with later received downhole data. Utilizing a regression analysis based on a set of recently time-stamped actual pressure measurements, the model may be adjusted to more accurately predict actual pressure and the required backpressure.

Figure 5:
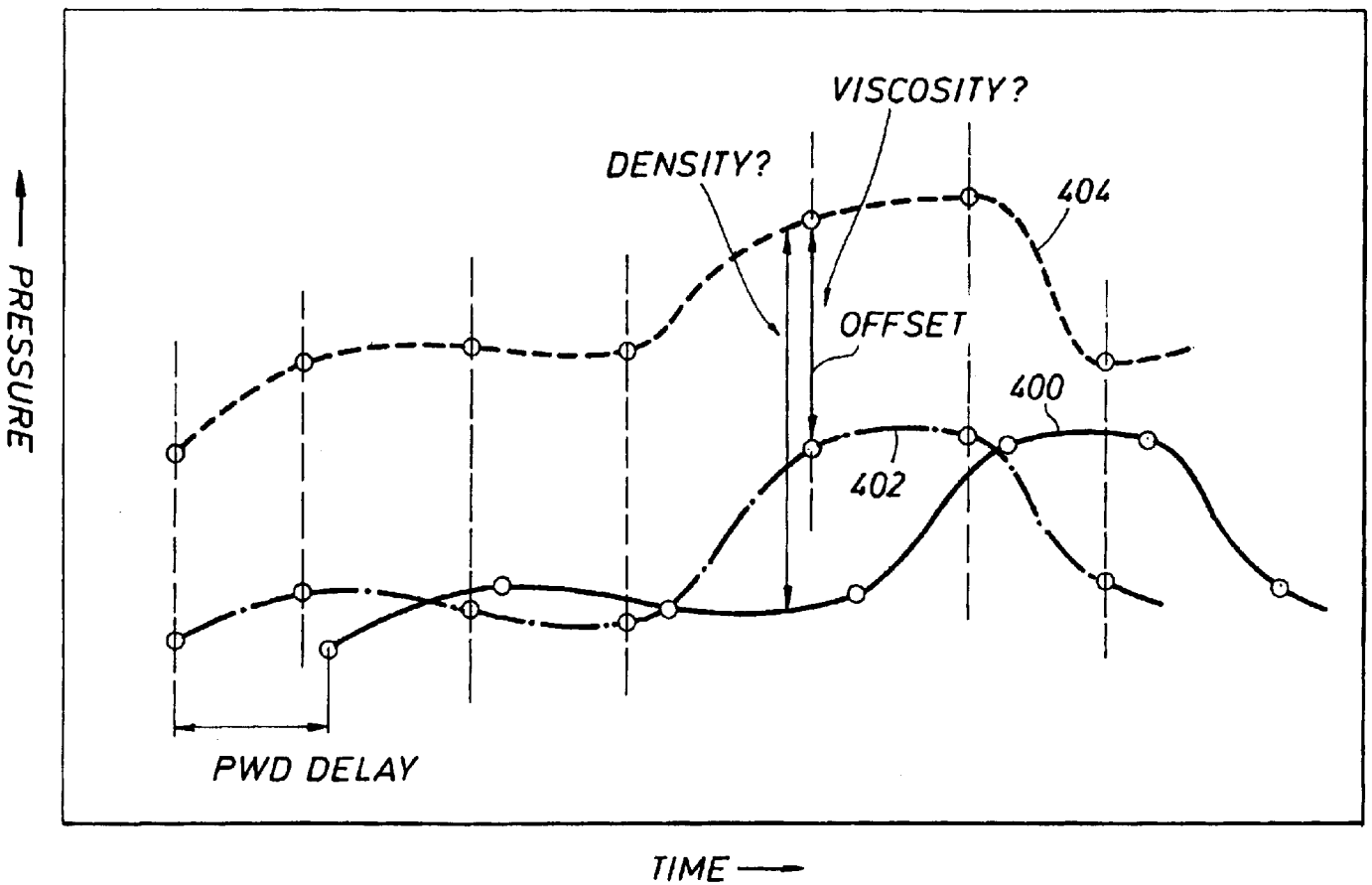
FIG. 5 is a graph depicting the correlation of predicted annular pressures to measured annular pressures.
Figure 6:
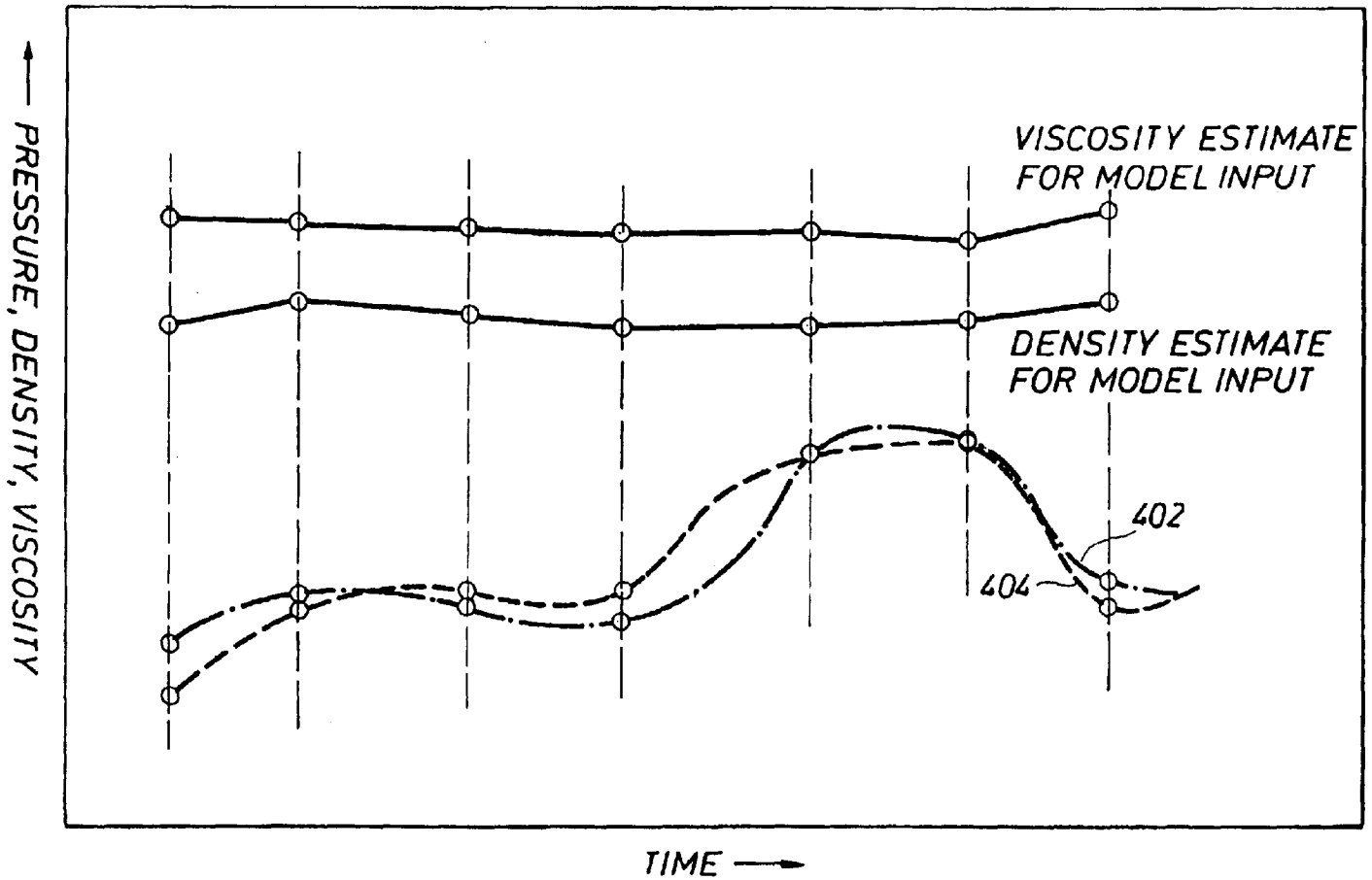
FIG. 6 is a graph depicting the correlation of predicted annular pressures to measured annular pressures depicted in FIG. 5, upon modification of certain model parameters.

FIG. 5 depicts the operation of the DAPC control system demonstrating an uncalibrated DAPC model. It will be noted that the downhole pressure while drilling (PWD) 400 is shifted in time as a result of the time delay for the signal to be selected and transmitted uphole. As a result, there exists a significant offset between the DAPC predicted pressure 404 and the non-time stamped PWD 400. When the PWD is time stamped and shifted back in time 402, the differential between PWD 402 and the DAPC predicted pressure 404 is significantly less when compared to the non-time shifted PWD 400. Nonetheless, the DAPC predicted pressure differs significantly. As noted above, this differential is addressed by modifying the model inputs for fluid 150 density and viscosity. Based on the new estimates, in FIG. 6, the DAPC predicted pressure 404 more closely tracks the time stamped PWD 402. Thus, the DAPC model uses the PWD to calibrate the predicted pressure and modify model inputs to more accurately predict downhole pressure throughout the entire borehole profile.

Based on the DAPC predicted pressure, the DAPC control system 236 will calculate the required backpressure level 266 and transmit it to the programmable logic controller 240. The programmable controller 240 then generates the necessary control signals to choke 130, valves 121 and 123, and backpressure pump 128.

Applications of the DAPC System

Figure 1:
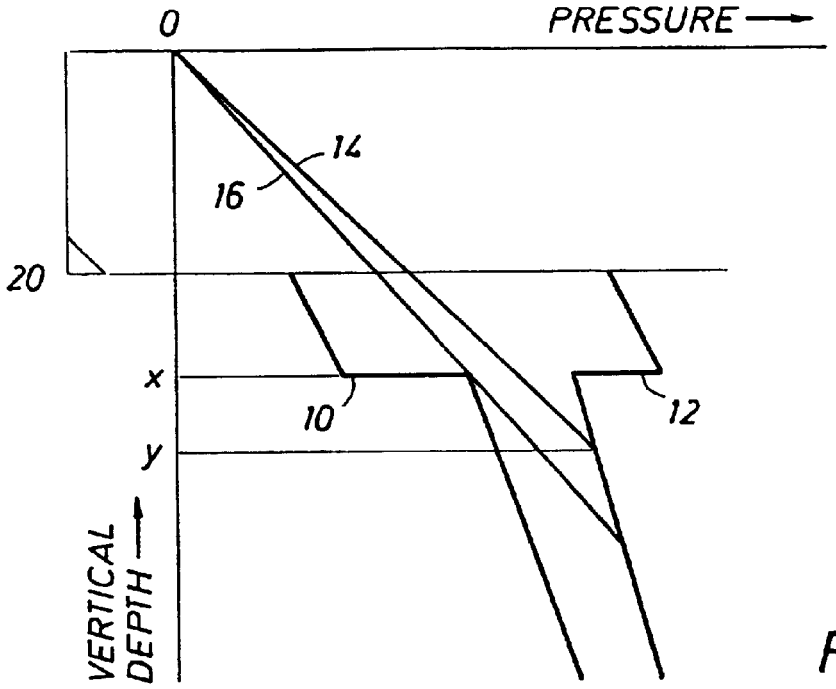
FIG. 1 is a graph depicting annular pressures and formation pore and fracture pressures.
Figure 7:
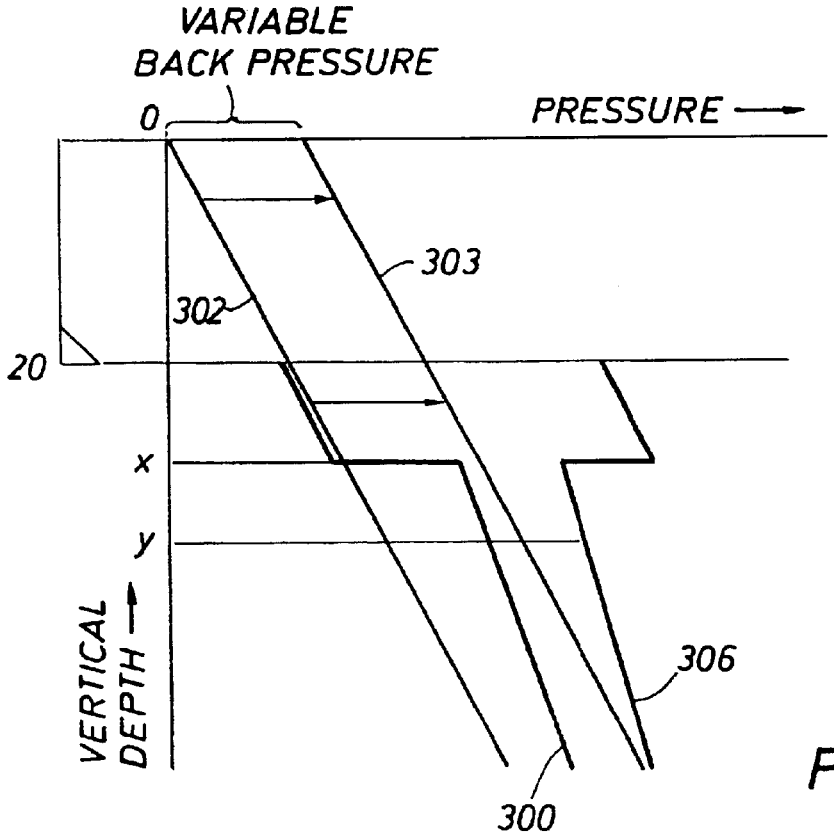
FIG. 7 is a graph depicting how the method of the present invention may be used to control variations in formation pore pressure in an overbalanced condition.

The advantage in utilizing the DAPC backpressure system may be readily in the chart of FIG. 7. The hydrostatic pressure of the fluid is depicted in line 302. As may be seen, the pressure increases as a linear function of the depth of the borehole according to the simple formula:

$$P=\rho TVD+C \quad [1]$$

Where P is the pressure, ρ is the fluid density, TVD is the total vertical depth of the well, and C is the backpressure. In the instance of hydrostatic pressure 302, the density is that of water. Moreover, in an open system, the backpressure C is zero. However, in order to ensure that the annular pressure 303 is in excess of the formation pore pressure 300, the fluid is weighted, thereby increasing the pressure applied as the depth increases. The pore pressure profile 300 can be seen in FIG. 7, linear, until such time as it exits casing 301, in which instance, it is exposed to the actual formation pressure, resulting in a sudden increase in pressure. In normal operations, the fluid density must be selected such that the annular pressure 303 exceeds the formation pore pressure below the casing 301.

In contrast, the use of the DAPC permits an operator to make essentially step changes in the annular pressure. Multiple DAPC pressure lines 304, 306, 308 and 310 are depicted in FIG. 7. In response to the pressure increase seen in the pore pressure at 300*b*, the back pressure C may be increased to step change the annular pressure from 304 to 306 to 308 to 310 in response to increasing pore pressure 300*b*, in contrast with normal annular pressure techniques as depicted in line 303. The DAPC concept further offers the advantage of being able to decrease the back pressure in response to a decrease in pore pressure as seen in 300*c*. It will be appreciated that the difference between the DAPC maintained annular pressure 310 and the pore pressure 300*c*, known as the overbalance pressure, is significantly less than the overbalance pressure seen using conventional annular pressure control methods 303. Highly overbalanced conditions can adversely affect the formation permeability be forcing greater amounts of borehole fluid into the formation.

Figure 8:
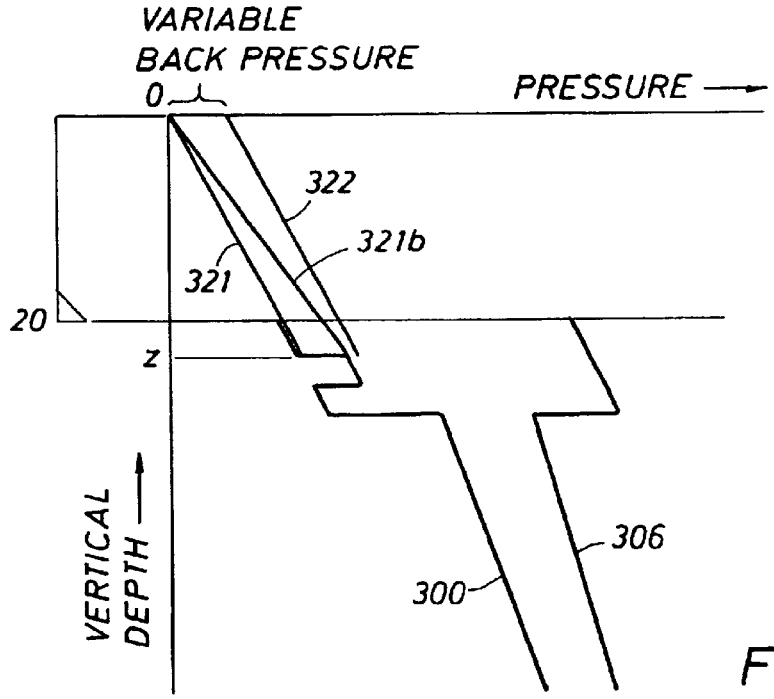
FIG. 8 is a graph depicting the method of the present invention as applied to at balanced drilling.

FIG. 8 is a graph depicting one application of the DAPC system in an At Balance Drilling (ABD) environment. The situation in FIG. 8 depicts the pore pressure in an interval 320*a* as being fairly linear until approximately 2 km TVD, and as being kept in check by conventional annular pressure 321*a*. At 2 km TVD a sudden increase in pore pressure occurs at 320*b*. Utilizing present techniques, the answer would be to increase the fluid density to prevent formation fluid influx and sloughing off of the borehole mud cake. The resulting increase in density modifies the pressure profile applied by the fluid to 321*b*. However, in doing so it dramatically increases the overbalance pressure, not only in region 320*c*, but in region 320*a* as well.

Using the DAPC technique, the alternative response to the pressure increase seen at 320*b*, would be to apply backpressure to the fluid to shift the pressure profile to the right, such that pressure profile 322 more closely matches the pore pressure 320*c*, as opposed to pressure profile 321*b*.

The DAPC method of pressure control may also be used to control a major well event, such as a fluid influx. Under present methods, in the event of a large formation fluid influx, such as a gas kick, the only option was to close the BOPs to effectively to shut in the well, relieve pressure through the choke and kill manifold, and weight up the drilling fluid to provide additional annular pressure. This technique requires time to bring the well under control. An alternative method is sometimes called the "Driller's" method, which utilizes continuous circulation without shutting in the well. A supply of heavily weighted fluid, e.g., 18 pounds per gallon (ppg) (3.157 kg/l) is constantly available during drilling operations below any set casing. When a gas kick or formation fluid influx is detected, the heavily weighted fluid is added and circulated downhole, causing the influx fluid to go into solution with the circulating fluid. The influx fluid starts coming out of solution upon reaching the casing shoe and is released through the choke manifold. It will be appreciated that while the Driller's method provides for continuous circulation of fluid, it may still require additional circulation time without drilling ahead, to prevent additional formation fluid influx and to permit the formation fluid to go into circulation with the now higher density drilling fluid.

Utilizing the present DAPC technique, when a formation fluid influx is detected, the backpressure is increased, as opposed to adding heavily weighted fluid. Like the Driller's method, the circulation is continued. With the increase in pressure, the formation fluid influx goes into solution in the circulating fluid and is released via the choke manifold. Because the pressure has been increased, it is no longer necessary to immediately circulate a heavily weighted fluid. Moreover, since the backpressure is applied directly to the annulus, it quickly forces the formation fluid to go into solution, as opposed to waiting until the heavily weighted fluid is circulated into the annulus.

Figure 9A:
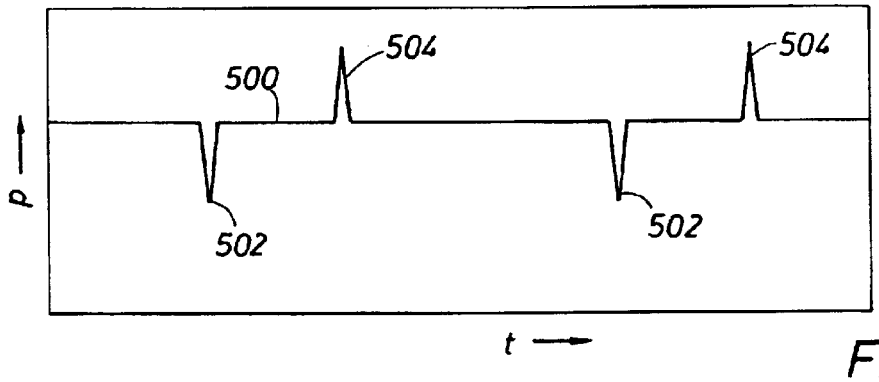
FIGS. 9A and 9B are graphs depicting how the present invention may be used to counteract annular pressure drops and spikes that accompany pump off/pump on conditions.
Figure 9B:
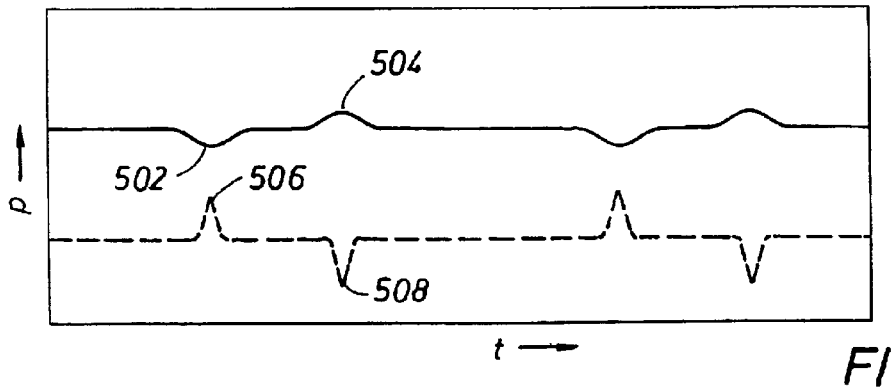

An additional application of the DAPC technique relates to its use in non-continuous circulating systems. As noted above, continuous circulation systems are used to help stabilize the formation, avoiding the sudden pressure 502 drops that occurs when the mud pumps are turned off to make/break new pipe connections. This pressure drop 502 is subsequently followed by a pressure spike 504 when the pumps are turned back on for drilling operations. This is depicted in FIG. 9A. These variations in annular pressure 500 can adversely affect the borehole mud cake, and can result in fluid invasion into the formation. As shown in FIG. 9B, the DAPC system backpressure 506 may be applied to the annulus upon shutting off the mud pumps, ameliorating the sudden drop in annulus pressure from pump off condition to a more mild pressure drop 502. Prior to turning the pumps on, the backpressure may be reduced such that the pump on condition spike 504 is likewise reduced. Thus the DAPC backpressure system is capable of maintaining a relatively stable downhole pressure during drilling conditions.

Although the invention has been described with reference to a specific embodiment, it will be appreciated that modifications may be made to the system and method described herein without departing from the invention.

I claim:

1. A system for controlling formation pressure during the drilling of a subterranean formation, comprising:

a drill string extending into a borehole, the drill string including a bottom hole assembly, the bottom hole assembly comprising, drill bit, sensors, and a telemetry system capable of receiving and transmitting data, including sensor data, said sensor data including at least pressure and temperature data;

a surface telemetry system for receiving data and transmitting commands to the bottom hole assembly;

a primary pump for selectively pumping a drilling fluid from a drilling fluid source, through said drill string, out said drill bit and into an annular space created as said drill string penetrates the formation;

a fluid discharge conduit in fluid communication with said annular space for discharging said drilling fluid to a reservoir to clean said drilling fluid for reuse;

a fluid backpressure system connected to said fluid discharge conduit; said fluid backpressure system comprised of a flow meter, a fluid choke, a backpressure pump, a fluid source, whereby said backpressure pump may be selectively activated to increase annular space drilling fluid pressure.

2. The system of claim 1, further including a pressure monitoring system, capable of receiving drilling operational data, said drilling operational data including drill string weight on bit, drill string torque on bit, drilling fluid weight, drilling fluid volume, primary and backpressure pump pressures, drilling fluid flow rates, drill string rate of penetration, drill string rotation rate, and sensor data transmitted by said bottom hole assembly.

3. The system of claim 2, wherein said pressure monitoring system utilizes said drilling operational data to monitor existing said annular space pressures during drilling operations;

model borehole expected pressures for continued drilling; and control said primary pump and fluid backpressure system in response to existing annular pressures and borehole expected pressures.

4. The system of claim 3, wherein said pressure monitoring system further includes communication means, processing means, and control means for controlling said primary pump and fluid backpressure system.

5. The system of claim 1, wherein said fluid backpressure system fluid source is said drilling fluid source.

6. The system of claim 1, wherein said fluid backpressure system fluid source is said fluid discharge conduit.

7. A method for controlling formation pressure during the drilling of a subterranean formation, the steps comprising:

deploying a drill string extending into a borehole, the drill string including a bottom hole assembly, the bottom hole assembly comprising, drill bit, sensors, and a telemetry system capable of receiving and transmitting data, including sensor data, said sensor data including at least pressure and temperature data;

providing a surface telemetry system for receiving data and transmitting commands to said bottom hole assembly;

selectively pumping a drilling fluid utilizing a primary pump from a drilling fluid source, through said drill string, out said drill bit and into an annular space created as said drill string penetrates the formation;

providing a fluid discharge conduit in fluid communication with said annular space for discharging said drilling fluid to a reservoir to clean said drilling fluid for reuse;

selectively increasing annular space drilling fluid pressure utilizing a fluid backpressure system connected to said fluid discharge conduit; said fluid backpressure system comprised of a flow meter, a fluid choke, a backpressure pump, and a fluid source.

8. The method of claim 7, further providing a pressure monitoring system for receiving drilling operational data, said drilling operational data including drill string weight on bit, drill string torque on bit, drilling fluid weight, drilling fluid volume, primary and backpressure pump pressures, drilling fluid flow rates, drill string rate of penetration, drill string rotation rate, and sensor data transmitted by said bottom hole assembly.

9. The method of claim 8, wherein said pressure monitoring system, utilizing said drilling operational data, further monitors existing said annular space pressures during drilling operations;

models borehole expected pressures for continued drilling; and controls said primary pump and fluid backpressure system in response to existing annular pressures and borehole expected pressures.

10. The method of claim 9, wherein said pressure monitoring system further includes communication means, processing means, and control means for controlling said primary pump and fluid backpressure system.

11. The method of claim 7, wherein said fluid backpressure system fluid source is said drilling fluid source.

12. The method of claim 7, wherein said fluid backpressure system fluid source is said fluid discharge conduit.

* * * * *